United States Patent [19]

Davis et al.

[11] 4,280,675

[45] Jul. 28, 1981

[54] CONTROLLABLE KITE

[76] Inventors: Lynn M. Davis, 1354 NW. 4th St., Boca Raton, Fla. 33432; James V. Theis, Jr., 5151 Washington Rd., Del Ray Beach, Fla. 33445

[21] Appl. No.: 120,445

[22] Filed: Feb. 11, 1980

Related U.S. Application Data

[63] Continuation of Ser. No. 908,653, May 23, 1978, abandoned.

[51] Int. Cl.[3] ..... B64C 31/06

[52] U.S. Cl. ..... 244/155 A; 74/129

[58] Field of Search ..... 244/153 R–155 A; 74/128–129

[56] References Cited

U.S. PATENT DOCUMENTS

| | | | |
|---|---|---|---|
| 1,167,179 | 1/1916 | Hires | 74/129 |
| 2,059,634 | 11/1936 | Fisher, Jr. | 244/155 R |
| 2,556,877 | 6/1951 | Howard | 244/155 A |
| 2,613,894 | 10/1952 | Howard | 244/155 A |
| 2,696,960 | 12/1954 | Howard | 244/155 A |
| 3,735,949 | 5/1973 | Theis | 244/155 A |

FOREIGN PATENT DOCUMENTS

| | | | |
|---|---|---|---|
| 2002872 | 7/1970 | Fed. Rep. of Germany | 244/155 R |

*Primary Examiner*—Galen L. Barefoot

*Attorney, Agent, or Firm*—Jack N. McCarthy

[57] ABSTRACT

A kite that is controllable from the ground by a control cord connected to the kite. The cord is connected to a control on the kite for moving a bridle loop which repositions the location of the connection of the cord to the bridle loop with relation to the kite. This movement of the bridle loop alters the flying attitude of the kite. The control includes a camming mechanism for moving the bridle loop in two steps between different positions through a control arm. The camming mechanism is actuated by a spring for the first step when tension on the control cord is released and by the force of the wind on the kite for the second step when the necessary tension is placed back in the control cord, said force of the wind also replacing energy in the spring for the next desired movement of the bridle loop.

10 Claims, 14 Drawing Figures

FIG. 1
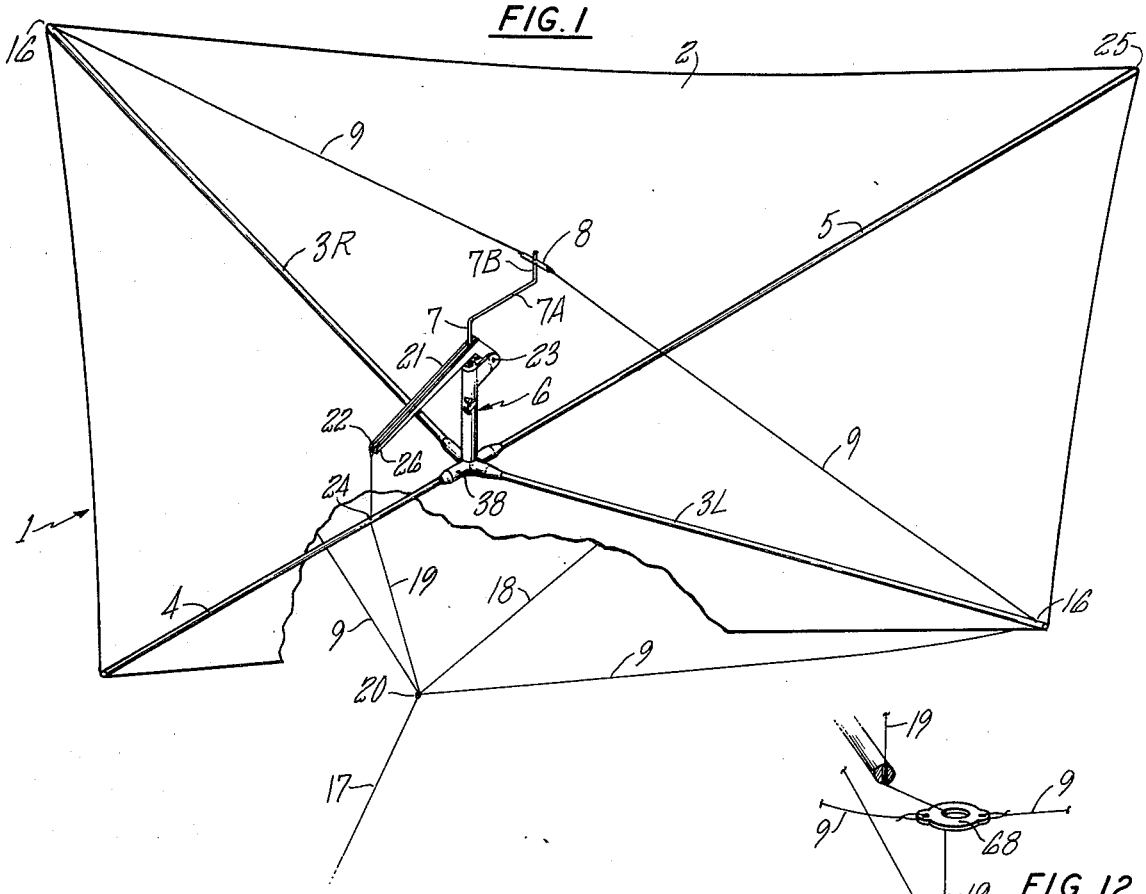
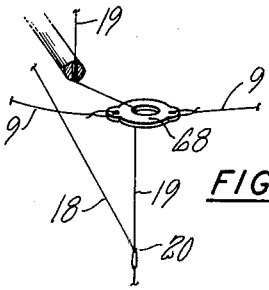
FIG. 12
FIG. 3
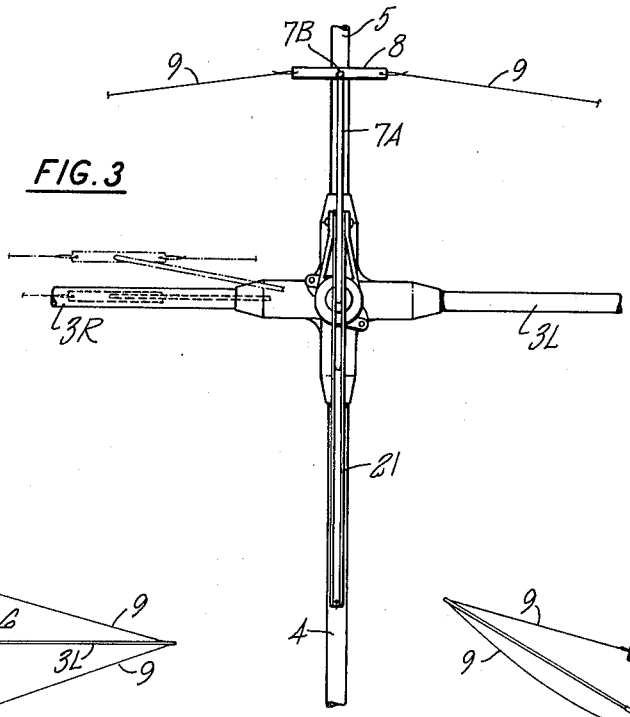
FIG. 2
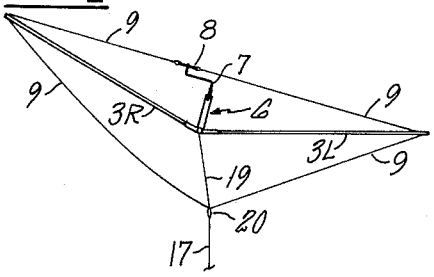
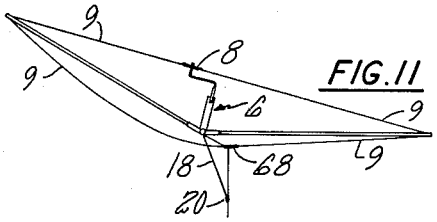
FIG. 11

CONTROLLABLE KITE

This is a continuation of application Ser. No. 908,653 filed May 23, 1978, now abandoned.

BACKGROUND OF THE INVENTION

This invention relates to controllable kites, especially to one wherein the kite maneuvering cord, which is held by an operator, can change the relative positioning of the attachement of the maneuvering, or control, cord to the flight surface of the kite. The most pertinent prior art is U.S. Pat. No. 3,735,949 to James V. Theis, Jr. In this patent, a kite is shown having a type of control construction having a rubber band powered escapement to control the turning of a crank arm to four different positions, each movement of the crank shifting a bridle to laterally shift the maneuvering, or control, cord relative to the kite for maneuvering thereof. However, using this prior art type of control construction, the kite can be maneuvered only as long as the rubber band motor can provide movement of the crank and escapement to permit movement of the bridle. Other patents of interest are U.S. Pat. Nos. 2,556,877; 2,613,894; and 2,696,960.

SUMMARY OF THE INVENTION

A primary object of this invention is to provide a kite control which would eliminate the need of a motor to drive a control arm by providing means using the force of the wind on the kite and biasing means to provide the energy required to turn the control arm.

It is another object of this invention to provide a kite control in which the bridle is shifted substantially laterally by rotation of the control arm which is moved between various positions on the kite to shift the attachment point of a control line to the kite, a portion of the arm movement between its various positions being moved by a spring action while the remainder of the movement is brought about by wind forces on the kite.

It is a further object of this invention to provide a kite control device in which a control arm can be placed in various positions to shift the attachment point of a control line to a kite, said control device having fixed and movable cam surfaces to rotate the control arm and stops that maintain various positions until it is desired to change them. The force to cam the control arm through the first portion of its movement is provided by a spring, while the force to provide the remainder of the movement of the control arm and to store energy in the spring is provided by the force of the wind on the kite.

It is another object of this invention to provide a removable tail or streamer which is removable in flight for controlling continued flight; this streamer when pulled from the kite will alter a portion of the control system so that flight will be unstable and the kite will encounter difficulty in staying aloft; use of kites having these streamers will enable the two operators to engage in a "fight" with each kite being maneuvered in an attempt to pull the streamer from the other kite.

BRIEF DESCRIPTION OF THE DRAWINGS

FIG. 1 shows a perspective view of a kite showing the control device positioned for straight flight;

FIG. 2 is a front view showing the control positioned for a turning maneuver of the kite;

FIG. 3 is an enlarged top view of the center construction of the kite showing the movement of the radially offset control arm section of the control device;

FIG. 11 shows a modified kite control arrangement positioned for a turning maneuver of the kite;

FIG. 12 shows an enlargement of the attaching means of FIG. 11;

DESCRIPTION OF THE PREFERRED EMBODIMENT

Figure 4:
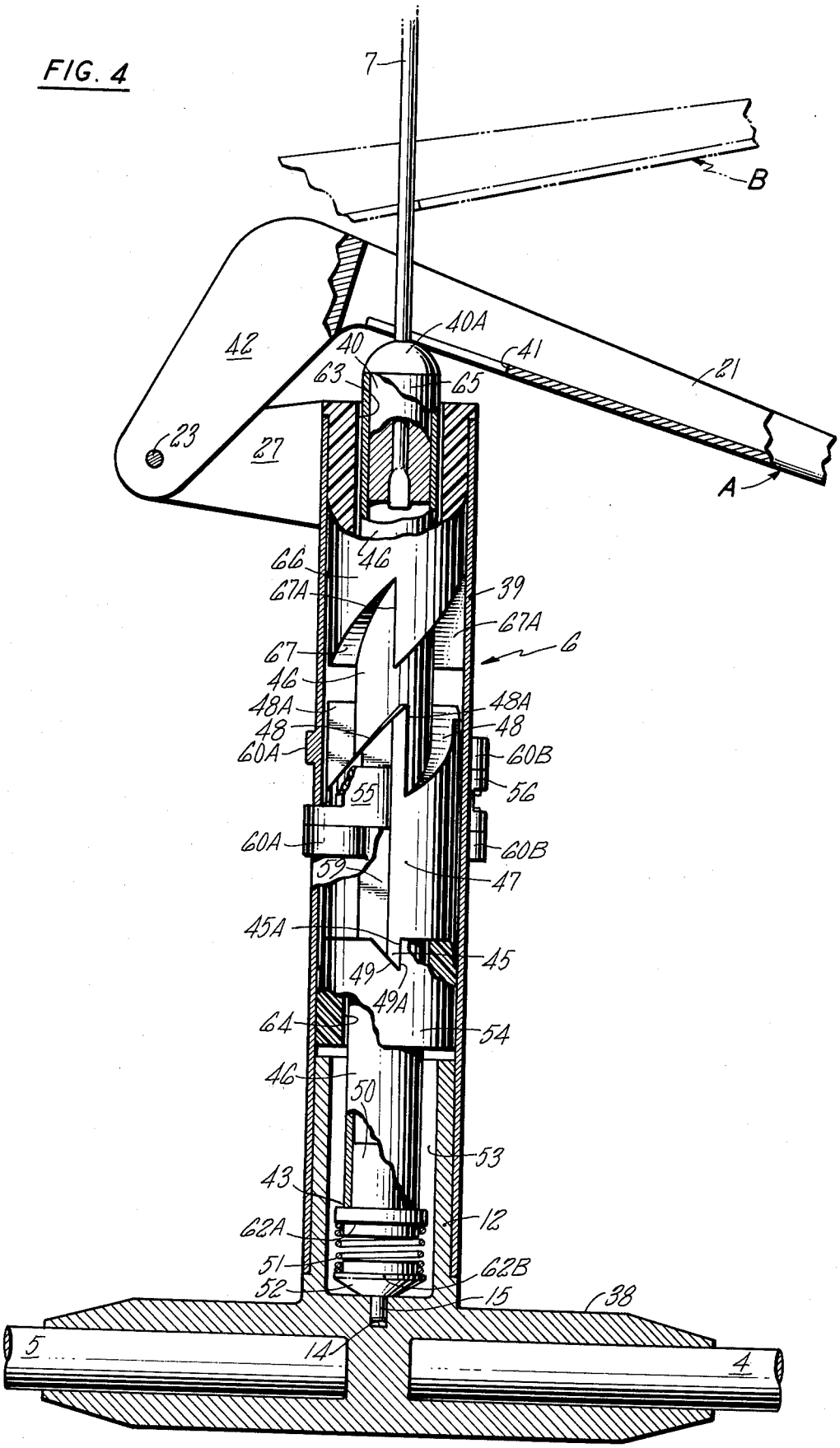
FIG. 4 is an enlarged view of the control device.

As shown in FIG. 1, a kite 1 is shown having a frame comprising a center X-shaped member 38 which serves to support a front keel member 4, a rear keel member 5, a right cross member 3R, and a left cross member 3L fixed thereto. Center member 38 also supports an upstanding, flight control device 6 to be hereinafter discussed. A conventional fabric 2 is fixed to the free ends of the keel members 4 and 5, and cross members 3R and 3L by any means desired.

The control device 6 includes an upstanding cylindrical housing 39, the lower end of said housing 39 being positioned over and fixed to an upstanding cylindrical boss 12 located at the center of the X-shaped member 38. Said cylindrical boss 12 has a cylindrical recess 53 formed therein for a purpose to be hereinafter described. A lower annular cam body 54 is fixed to the interior of the cylindrical housing 39 just above the top of the cylindrical boss 12 and an upper annular cam body 66 is fixed to the interior of the cylindrical housing 39 at the top thereof. The lower annular cam body 54 has four equally spaced upper cam surfaces 45 with stop surfaces 45A at the ends thereof, and the upper annular cam body 66 has four equally spaced lower cam surfaces 67 with stop surfaces 67A at the ends thereof. A main movable annular cam body 47 is fixed to a shaft 46 and located in housing 39 for movement between the upper and lower cam bodies 66 and 54, respectively. Annular cam body 47 has an upper surface with four equally spaced cam surfaces 48 for engaging cam surfaces 67 and four stop surfaces 48A for engaging stop surfaces 67A for fixedly positioning cam body 47 in its upper position, and a lower surface with four equally spaced cam surfaces 49 for engaging cam surfaces 45 and four stop surfaces 49A for engaging stop surfaces 45A for fixedly positioning cam body 47 in its lower position.

Figure 7:
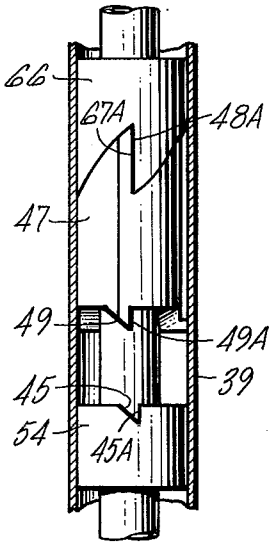
FIG. 7 is a fragmentary view through the control device with the main annular cam body in its upper position.
Figure 6:
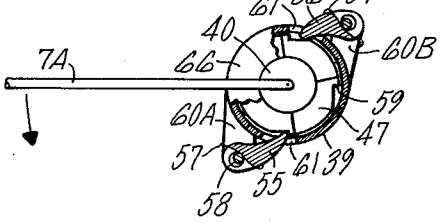
FIG. 6 is a fragmentary view through the control device showing the pawl positions for the cam position in FIG. 5.

The upper part of shaft 46 is mounted for axial movement in the center opening 63 in annular cam body 66 and the lower part of shaft 46 is mounted for axial movement in the center opening 64 in lower annular cam body 54. The lower end 43 of the shaft 46 extends into the interior of cylindrical boss 12. Shaft 46 is hollow and has a member 50 fixed therein with a spring seat 62A. A spring pivot member 52 with guide pin 15 is mounted to permit rotation in a hole 14 in the bottom of the cylindrical boss 12 and has a spring seat 62B facing spring seat 62A; a spring 51 is located between the spring seats 62A and 62B biasing shaft 46 and cam body 47 upward for a purpose to be hereinafter disclosed. With no downward force on shaft 46, cam body 47 is positioned as shown in FIG. 7.

Cam body 47 is also provided with four equally spaced longitudinal grooves having a holding face 59 to prevent clockwise rotation thereof and keep it properly aligned axially with cam bodies 54 and 66 as it moves between them. Pawls 55 and 56 are provided to engage the holding faces 59 of the grooves. These pawls 55 and 56 are pivotally mounted on pins 58 at one end on brackets 60A and 60B, respectively, and have their actuating ends extending through openings 61 in the cylindrical housing 39. The pawls 55 and 56 are biased inwardly by springs 57 to hold the actuating ends against the surface of the cam body 47 as it rotates counterclockwise. The pawl 55 has its mounting bracket 60A positioned on cylindrical housing 39 so that when cam body 47 is in its lower position (FIG. 5, FIG. 9) it engages a holding face 59 and the cam surfaces 48 are aligned axially with cam surfaces 67 to have their first meeting engagements at a point on the cam surface 67 as they are moved upwardly with shaft 46 by spring 51. As cam surfaces 48 engage cam surfaces 67, cam body 47, shaft 46 and control arm 7 (to be hereinafter described) are caused to be rotated 80° until stop surfaces 48A and 67A cause upward movement and rotation to be stopped at the chosen location. At this point, the pawl 56 has its mounting bracket 60B positioned on cylindrical housing 39 so that when cam body 47 is in its upper position (FIG. 7) pawl 56 engages a holding face 59 and the cam surfaces 49 are aligned axially with cam surfaces 45 to have their first engagement at a point on the cam surfaces 45 as they are moved downwardly with shaft 46 by an external force or shaft 46, where they will rotate the cam body 47, shaft 46 and a control arm 7 an additional 10°, completing one of the four 90° movements of the control arm.

Figure 9:
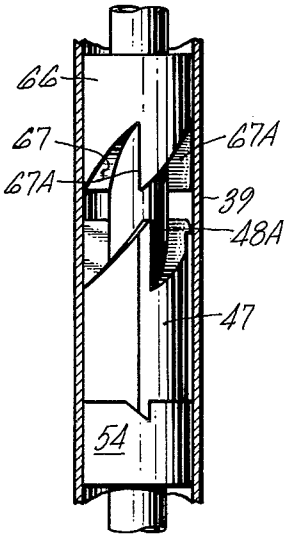
FIG. 9 is a fragmentary view of the control device with the main annular cam body in its lower position.
Figure 8:
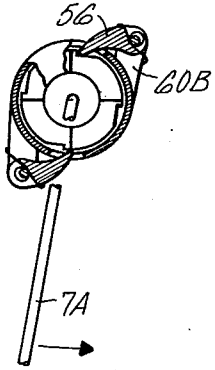
FIG. 8 is a fragmentary view through the control device showing the pawl positions for the cam position in FIG. 7 after the radial control arm section has moved 80° from FIG. 6.

The upper end 65 of the shaft 46 projects from the center opening 63 in upper annular cam body 66 and has its range of movement limited by movement of cam body 47 between the lower cam surface 45 and the upper cam surface 67. An insert 40 is fixed in the upper end 65 of the shaft 46 having a spherical shape 40A on the top thereof. An axially central section of control arm 7 is fixed to the center of the insert 40 and extends upwardly therefrom through the spherical shape 40A having a radially offset control arm section 7B connected thereto by a radial control arm section 7A. Brackets 27 extend outwardly from the top of the cylindrical housing 39 aligned with the rear keel member 5. A lever arm 21 is pivotally mounted at one end between the ends of brackets 27 by a pin 23; the lever arm has a short section 42 extending upwardly from pin 23 with the remainder of the lever arm 21 extending over the top of the cylindrical housing 39 and along the front keel member 4. A slot means 41 is formed in the lever arm 21 to permit the control arm 7 to pass therethrough while the spherical shape 40A engages the lever arm 21 around the slot means 41 between positions A and B of FIG. 4. With a predetermined downward force on shaft 46 by lever arm 21, overcoming spring 51, cam body 47 is positioned as shown in FIGS. 5 and 9.

As shown in FIGS. 1 and 3, the top of the radially offset section 7B has a member 8 pivotally mounted thereon. A bridle loop 9 has one end fixed to one end of member 8, with the other end extending through a loop guide 16 at the outer end of left cross member 3L, back through a loop guide 16 at the outer end of right cross member 3R, and then fixed to the other end of member 8. With the radial section 7A extending along the front or rear keel member, 4 or 5, respectively, the end of a flying line 17 is attached to the bridle loop at a center point 20. A keel line 18 extends from the rear end 25 of rear keel member 5 and is also fixed to the point 20. An actuating line 19 is fixed to the free end 26 of the lever arm 21 of an attachment point 22 and after passing through a guide hole 24 in the front keel member 4 below attachment point 22, the other end of the line 19 is also fixed to the point 20.

When the radial section 7A of control arm 7 extends along the front keel member 4 or the rear keel member 5, the kite is in a straight flight condition and may be considered as upright in the normal stable attitude of a non-maneuverable kite of this type; when the radial section 7A extends substantially along the right cross member 3R or along the left cross member 3L, the kite is in a turning condition to the right or left.

Figure 10:
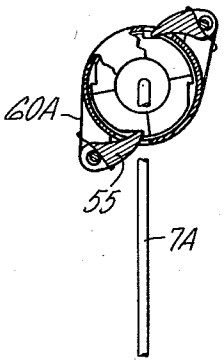
FIG. 10 is a fragmentary view through the control device showing the pawl positions for the cam position in FIG. 9 after the radial control arm section has moved 10° from FIG. 8 and 90° from FIG. 6.
Figure 5:
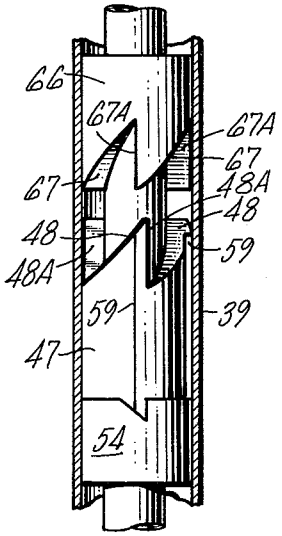
FIG. 5 is a fragmentary view of the control device with the main annular cam body in its lower position.

It can be seen that in flight with the control (maneuvering or flying) line 17 held by an operator, the lifting force on the surface of the kite places the actuating line 19 in tension through hole 24, placing the lever arm 21 in its lowermost position, shown by A in FIG. 4, and also shown in FIG. 1. The location of the center point 20 controls the flight attitude of the kite. The control device 6 provides for the movement of the center point 20 to four positions; two of these positions being at the same location directly under the center of the kite for stable straight flight; another position shifts the center point 20 to the left, as shown in FIG. 2, while another position shifts the center point 20 to the right. To shift the center point 20 between any of its two adjacent positions, it is moved in a predetermined sequence; that is, from a center position, to a left position, to a center position, to a right position and back to the center position, and so on; the operator momentarily reduces tension on the control line 17 which permits the spring 51 to move the cam body 47 and control arm 7 to the position shown in FIG. 7 and lever arm 21 to position B as shown in FIG. 4 where the radial control arm section 7A has been moved 80°. When the wind strikes the kite, retensioning the control line 17, the tension is transferred through the actuating line 19 to the lever arm 21 which moves to position A. This in turn causes shaft 46 and cam 47 to be moved downward rotating to a position as in FIGS. 4, 5, and 9. This causes the radial control arm section 7A to advance through the remaining 10° of rotation to complete the 90° movement, to the position shown in FIG. 10. The first 80° of rotation occurs while flight line is slack, while the remaining 10° occurs during the retensioning of the control line. While a first movement of 80° has been used with a second movement of 10°, other proportions of angular movement can be used. The flight action of this kite by an operator is the same as the flight action of the kite shown in U.S. Pat. No. 3,735,949.

A modification of this invention is illustrated in FIGS. 11 and 12. In this embodiment, the control device works as described in the preferred embodiment. However, the bridle line 9 is not attached to center point 20. Instead, each side of bridle loop 9 is attached to a corresponding side of guide ring 68. As the control device is caused to function as described in the preferred embodiment, guide ring 68 is caused to move to the same positions that were previously described for center point 20. That is, guide ring 68 is caused to move from the center to the left, back to the center, to the right and back to the center, and so on. As can be seen in FIGS. 11 and 12, when the guide ring is moved off center, it causes actuating line 19 to be pulled with it. This in turn causes center attachment point 20 to be moved off center, thereby causing the kite to maneuver as described for the preferred embodiment.

Figure 13:
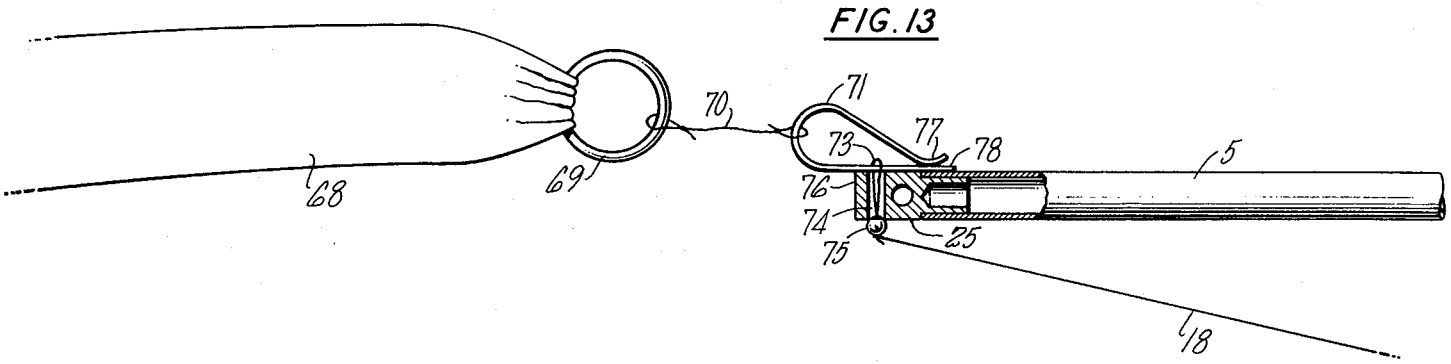
FIG. 13 shows a modified kite arrangement wherein a removable streamer or tail is used which is removable in flight for controlling continued flight of the kite.
Figure 14:
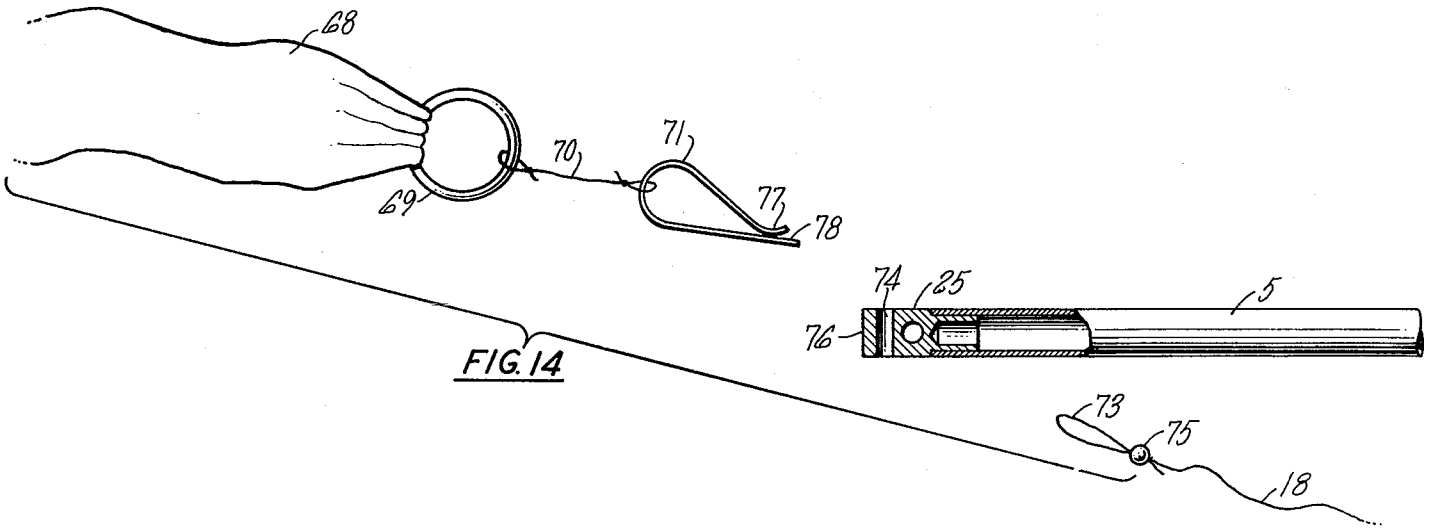
FIG. 14 is a view similar to FIG. 13 showing the tail or streamer removed from the kite, releasing the keel line.

A second modification of this invention is illustrated in FIGS. 13 and 14 whereby the kite is arranged so that in "battle" with a similar kite, for example, one of the kites can disable the other by striking a tail or streamer 68 to pull it from the kite 1. In these Figures, the fabric 2 is not shown. Keel line 18 is secured to the rear end 25 of keel member 5 by having a loop 73 formed at the end thereof and placed through an opening 74 in an insert 76 forming the rear end 25 of kite 1. A knot 75, or other type of enlargement, is located where the loop 73 ends along the length of keel line 18 and fixes the amount of loop 73 which projects from the upper part of opening 74 and the proper length of line 18. A spring clip 71 is connected with one leg 78 thereof extending through the loop 73 projecting from the opening 74 to hold line 18 in place. The other leg 77 of the clip presses against leg 78 to prevent it from being drawn from loop 73 during normal flight of the kite. A streamer, or tail, 68 is connected to the spring clip 71 by a ring 69 and string 70. The streamer is fixed to the ring 69 while the string is located between the spring clip and ring 69. The string 70 can merely be tied to the ring with a loop being formed on the opposite end and pulled over the leg 77.

It is to be recognized that the pressure between the legs 77 and 78 of the spring clip 71 must prevent the removal of spring clip 71 during normal operation with its attached streamer 68. This can be controlled knowing the size of the streamer to be used. During a "fight", one kite striking the tail or streamer of another, exerting sufficient pull to pull the clip 71 from the loop 73, thereby freeing the keel line 18 as shown in FIG. 14, would win a "fight". Since the keel line 18 is an integral part of the bridle arrangement for stable flight, the kite attachment 20 connected to flying line 17 would then be allowed to move to a position in which the kite could be uncontrollable and fall to the ground.

It will be apparent to those skilled in the art that the novel principles of the invention disclosed herein will suggest various modifications and applications of the same. It is accordingly desired that the present invention shall not be limited to the specific embodiments thereof described herein.

We claim:

1. A controllable kite; a control cord for controlling the kite from a location below; attachment means on said kite having an attachment location for connecting one end of said control cord thereto; said control cord being attached to said location; control means for moving the attachment means to which said control cord is attached to at least two different positions along a substantially lateral line permitting a change in attitude of the kite; means also connecting said control cord to said control means for maintaining the attachment means in one position or actuating the control means to move the attachment means to another position; said control means having a housing rigidly fixed to said kite, said housing having a member movable between different positions; said movable member being connected to said attachment means for moving it; said movable member being a shaft mounted for axial movement and stepped arcuate movement; biasing means for moving said movable member in one axial direction; said movable member being pulled in the other axial direction by said control cord; said means also connecting said control cord to said control means including a mechanical advantage means connected between said control cord and said movable member; cam means mounted on said housing and said movable member to provide for stepped arcuate movement of said movable member as it is moved axially for repositioning said attachment means.

2. A controllable kite as set forth in claim 1 wherein said movable member extends externally of said housing; said mechanical advantage means including a lever means connected to said housing and positioned to engage said external portion; said control cord being connected to said lever means for controlling its movement.

3. A controllable kite as set forth in claim 2 wherein the cam means on said movable member have a first upper and a first lower cam surface to engage a second lower cam surface on said housing and a second upper cam surface on said housing, respectively; said engagement of said first upper cam surface of said cam means with said second lower cam surface on said housing providing one stepped arcuate movement while engagement of said first lower cam surface with said second upper cam surface provides a second stepped arcuate movement placing said attachment means in a second position.

4. A controllable kite as set forth in claim 1 wherein said kite has a frame with a keel means and a cross means, said keel means and cross means being fixed together where they cross, said housing being rigidly fixed to said kite where said keel means and said cross means are fixed together.

5. A controllable kite as set forth in claim 4 wherein said housing extends upwardly from said frame.

6. A controllable kite as set forth in claim 2 wherein said shaft extends externally of said housing; said shaft being biased for moving said shaft in an axial direction out of said housing while said lever means engages the free external end of said shaft to move it in the other axial direction.

7. A control for changing linear movement back and forth along an axis into stepped arcuate movement about the same axis including a housing, a shaft being mounted for axial movement in said housing, a first cylindrical cam means being mounted on said shaft, said first cam means having a first annular upper surface with camming surfaces and a first annular lower surface with camming surfaces, said housing having a second cam means located below said first cam means and a third cam means located above said first cam means, said second cam means having a second annular upper surface with camming surfaces, said third cam means having a second annular lower surface with camming surfaces, biasing means in said housing for biasing said shaft in one direction for engaging the camming surfaces on said first annular upper surface of said first cam means with the camming surfaces on said second annular lower surface of said third cam means for rotating said shaft a predetermined amount, means for moving said shaft in the opposite direction against said biasing means for engaging the camming surfaces on said first annular lower surface of said first cam means with the camming surfaces on said second annular upper surface of said second cam means for rotating said shaft a second predetermined amount and for repositioning said biasing means to perform its function, said first cam means having longitudinal stop means for aligning the movement of said first cam means so that the camming surfaces thereon will engage the mating surfaces on the second cam means and the third cam means where desired, pawls mounted on said housing for engaging said longitudinal stop means to maintain the proper alignment of said first cam means.

8. A control as set forth in claim 7 wherein said longitudinal stop means comprises one or more longitudinal grooves extending along the surface of the first cam means, said pawls being positioned to engage at least one of said longitudinal grooves to align said camming surfaces on said first annular upper surface with the camming surfaces of said second annular lower surface and align the camming surfaces of said first annular lower surface with the camming surfaces on said second annular upper surface.

9. A controllable kite comprising a frame, said frame having a keel member and a cross member fixed thereto, flight control means including an attachment point below said keel member and cross member for a control line, means for shifting the attachment point to a plurality of lateral locations relative to the cross member to change kite attitude during flight, a tail streamer removably connected to said kite, removable pin means connecting said tail streamer to said flight control means wherein removal of said pin means in flight will render said kite unstable.

10. A controllable kite as set forth in claim 9 including a keel line extending from said attachment point to the rear of said keel member, said removable pin means connecting said rear of said keel line to the rear of said keel member so that when said pin means is removed said keel line member will be released permitting said attachment point to move to a position in which the kite would be uncontrollable.

* * * * *